United States Patent [19]

Vaccari et al.

[11] Patent Number: 4,507,877

[45] Date of Patent: Apr. 2, 1985

[54] HEATER DEVICE, PARTICULARLY FOR SKI BOOTS

[75] Inventors: Franco Vaccari, Montebelluna; Renzo Balbinot, Vittorio Veneto, both of Italy

[73] Assignee: Nordica S.p.A., Montebelluna, Italy

[21] Appl. No.: 458,676

[22] Filed: Jan. 17, 1983

[30] Foreign Application Priority Data

Jan. 22, 1982 [IT] Italy ..... 20611/82[U]
Apr. 28, 1982 [IT] Italy ..... 21707/82[U]

[51] Int. Cl.[3] ..... A43B 7/02; A43B 7/04; H05B 1/00

[52] U.S. Cl. ..... 36/2.6; 219/211

[58] Field of Search ..... 36/2.6; 219/211, 527; 128/382, 383; 126/206, 204

[56] References Cited

U.S. PATENT DOCUMENTS 3,663,796 5/1972 Hines et al. ..... 36/2.6 X
3,859,496 1/1975 Giese ..... 36/2.6 X
3,977,093 8/1976 Santroch ..... 36/2.6
4,273,989 6/1981 Hinton et al. ..... 219/211
4,279,255 7/1981 Huffman ..... 219/211 X

FOREIGN PATENT DOCUMENTS 2365973 4/1978 France ..... 36/2.6

*Primary Examiner*—James Chi Kee
*Attorney, Agent, or Firm*—Guido Modiano; Albert Josif

[57] ABSTRACT

A heater device particularly for ski boots, which comprises, located on the inner shoe of a ski boot, an electric resistance heater positioned at the user's foot sole and connected to a storage battery accommodated inside said inner shoe. The storage battery is connected to a recharge socket located at the top portion of said shoe and is connected to the resistance heater through a switch. Also provided is a voltage limiter adapted to prevent the storage battery from being discharged to below a preset voltage level.

6 Claims, 4 Drawing Figures

HEATER DEVICE, PARTICULARLY FOR SKI BOOTS

BACKGROUND OF THE INVENTION

This invention relates to a heater device, particularly for ski boots.

As is known, it is a long-established practice to heat ski boots using either electric power or catalytic combustion systems.

Specifically in the instance of electric heating, a device is utilized which comprises an electric resistance heater with a rechargeable battery supply.

Conventional devices are currently made available as kits for installation in existing ski boots.

This results in the user being forced to carry out sometimes fairly difficult operations to adapt the various kit components to a particular ski boot configuration where n the heater device is to be installed, to achieve an assembled outfit which is mostly objectionable both from the functional standpoint and practical standpoint.

Another disadvantage of prior devices is that in general a part of the component elements of the heater device are to be mounted on the inner shoe and part on the ski boot shell, which entails the establishment of connections between two parts of a ski boot which are separable.

Moreover, when the inner shoe is to be removed as for drying or other purposes the electric connectors must be first disconnected, with attendant risks of breakage or damaging the electric components and losing the installation integrity.

SUMMARY OF THE INVENTION

It is an object of this invention to remove such prior disadvantages by providing a heater device for ski boots which is so constructed as to perfectly fit with the ski boot, involving no connections between separable parts of the ski boot.

Another object of the invention is to provide a heater device as indicated, while allows the inner shoe to be easily removed from the ski boot, for possible use in other ski boot types, without affecting the electric components of the device.

A further object of this invention is to provide a device, which is structured for a rational arrangement of the various components, thus eliminating all risks of their getting damaged and making the operation of the various controls easier for the user.

Yet another object of the invention is to provide a heater device which is specially useful in ski boots, and prevents the storage battery supply from being exhausted completely, in order to avoid the battery voltage dropping to values whereat it is no longer rechargeable and reusable.

A not unimportant object of this invention is to provide a heater device which, by virtue of its peculiar features, can give full assurance of a reliable and safe operation.

These and other objects, such as will be apparent hereinafter, are achieved by a heater device particularly for ski boots, according to the invention, characterized in that it comprises, located on the inner shoe of a ski boot, an electric resistance heater positioned at the user's foot sole, or alternatively arranged to surround the user's foot, and being electrically connected to at least one storage battery accommodated in a seat defined in said inner shoe, said storage battery being connected to an electric storage battery recharging socket located at the top portion of said inner shoe, an electric switch being also provided in the supply circuit to said electric resistance heater.

BRIEF DESCRIPTION OF THE DRAWINGS

Further features and advantages will be apparent from the following detailed description of a heater device for ski boots, as illustrated by way of example and not of limitation in the accompanying drawings, where.

DESCRIPTION OF THE PREFERRED EMBODIMENT

Figure 1:
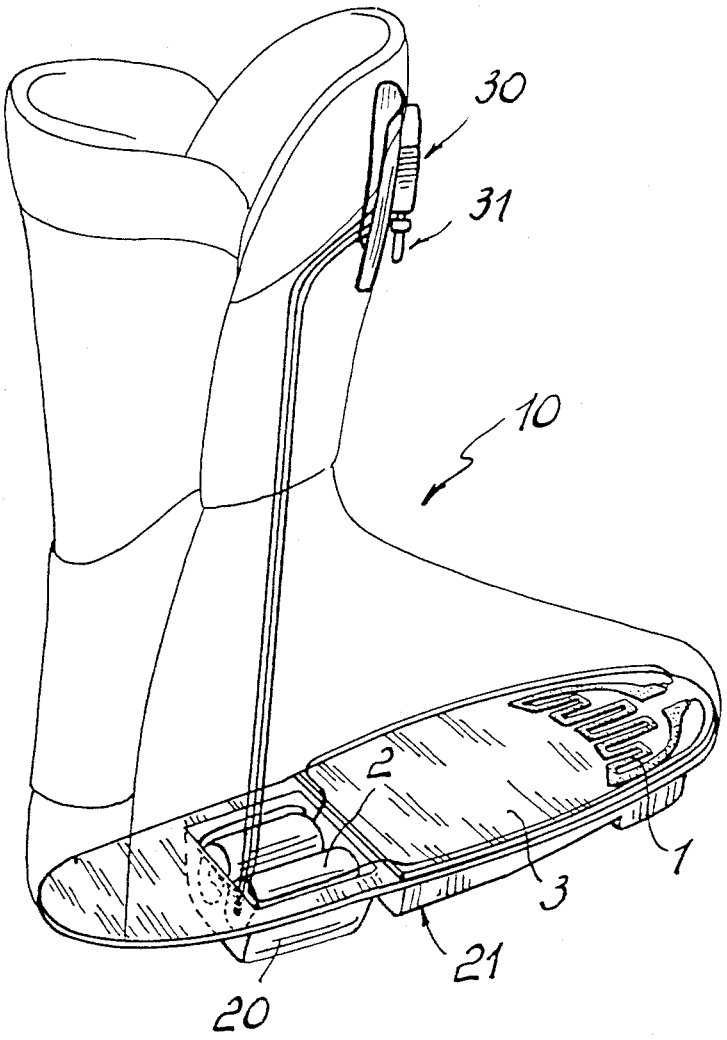
FIG. 1 shows schematically the heater device as positioned inside a ski boot inner shoe.
Figure 2:
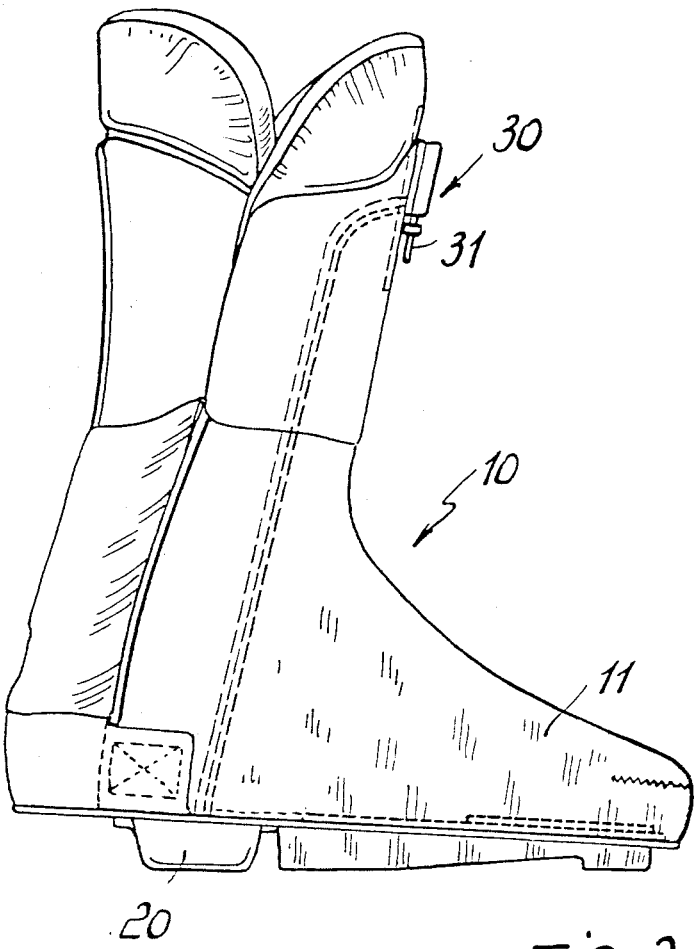
FIG. 2 is a side elevation view of the ski boot inner shoe with the heater device.
Figure 3:
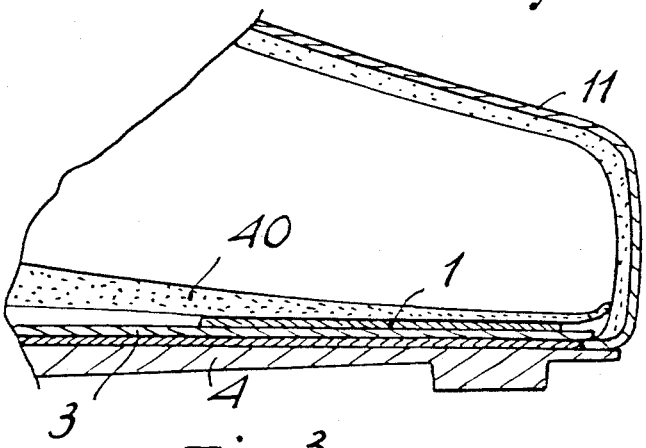
FIG. 3 is a sectional detail view of the inner shoe front portion accommodating the electric resistance heater.
Figure 4:
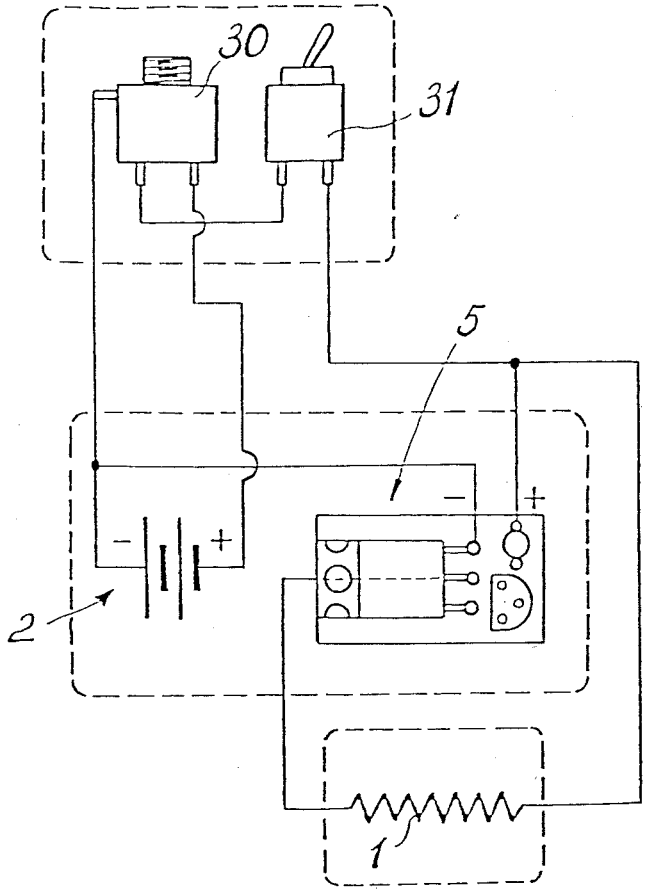
FIG. 4 shows the wiring diagram of the heater device according to the invention.

Making reference to the drawing figures, this heater device for ski boots comprises essentially an electric resistance heater 1 and a heater supply electric storage battery, which is generally designated with the reference numeral 2.

A peculiar feature of the invention is that all of the elements which comprise this heater device are perfectly fitted and inserted in the inner shoe, generally indicated at 10, thereby there exists no connections between the inner shoe and the shell wherein the inner shoe is inserted.

This feature enables the inner shoe to be readily removed from the shell without involving the opening or otherwise altering of the electric connections, while it enables the inner shoe to be also used in other ski boot types which can accept said inner shoe.

From the standpoint of its peculiar design features, this heater device comprises, as mentioned, an electric resistance heater 1, preferably but not necessarily in the form of a printed circuit which is provided on a foil 3 spanning the foot sole and has the function of radiating heat over a larger surface area while providing thermal insulation from the sole such as to avoid unnecessary waste of heat to the outside.

The cited foil is applied on the inner sole 4 of the shoe 10, so that in practice, the resistance heater and its insulating parts are directly fastened, as by sewing or the like techniques, to the upper 11 comprising the inner shoe.

The cited electric resistance heater 1 is fed by a pair of rechargeable electric storage batteries 2, of a currently available type on the market, which are placed in a container or the like element adapted to be received in a seat 20 specially provided at the padding 21 which is secured, as by cementing or sewing, to the inner shoe lower portion.

The cited storage battery 20 is connected to a recharging socket 30 which is located at the upper portion of the inner shoe, preferably at the front edge of the shoe cuff, or alternatively, at the rear or sides thereof, such as to be protected against water leakage or shocks which may result in damage.

Beside the recharging socket 30, there is provided a control switch 31, which is included in the supply circuit between the storage battery and resistance heater.

It should be noted, accordingly, that the control portion is also located at the upper portion of the inner shoe, where it is more readily and easily operated by the user.

In addition to the control switch, which as mentioned closes the circuit between the storage battery and resistance heater, an indicator is provided which serves to indicate when the battery reaches its minimum voltage below which further current drainage from the battery could result in damage.

As is customary for this type of storage batteries, the recharging socket is constructed such that, as the recharging transformer is applied, the circuit between the storage batteries and resistance heater is automatically opened.

Another peculiarity of the invention is that provided in combination with the resistance heater 1 and storage batteries 2, is a voltage limiter 5, which intervenes between the resistance heater 1 and storage batteries 2 to disconnect the electric connection between the resistance heater 1 and storage batteries 2 as the voltage level of the storage batteries 2 drops below a threshold value which can be preset during the manufacturing stage.

The voltage limiter 5 is connected with its input terminals between the negative pole of the storage batteries and positive pole, such as to constantly apply voltage control. As the voltage drops below a preset level, the voltage limiter will automatically cut off the electric supply to the resistance heater.

The use of a voltage limiter within the above context is of extreme importance because it allows the storage battery discharge voltage to be blocked off at a threshold value which permits the storage battery to be always recharged even if the user erroneously leaves the switch 31 in the closed position, that is erroneously keeps the resistance heater always electrically connected to the storage battery, or even where the user leaves the resistance heater on for an excessively long period of use.

It will be appreciated from the foregoing that the invention achieves its objects, and in particular that the device according to the invention, being entirely contained within the inner shoe, is first of all fully fitted with the ski boot assembly, and secondly enables a rational arrangement of the component elements, which results in an improved operation of the whole assembly.

Another important aspect is that the resistance heater, which may be arranged such as to affect just the foot or possibly the foot sole in its entirety, is carried on a foil effective to radiate and distribute the heat uniformly to the foot and thermally insulate the resistance heater against outside leakage.

Furthermore, the device, by preventing operation of the resistance heater at values below preset voltage values, affords the possibility of preserving the rechargeable storage battery by preventing it from reaching voltage levels which could be harmful.

It should be further added that above the resistance heater, inside the inner shoe, there is provided a preferably soft insole 40, which is formed with ventilation holes to facilitate transfer of heat to the interior.

Thus, the invention provides a perfectly integrated system which is designed to eliminate external connections and achieve a higher degree of reliability and safety in operation.

In practicing the invention, the materials used, if compatible with the specific use, and the dimensions and contingent shapes, may be any suitable ones for the intended application.

We claim:

1. A heater device for ski boots comprising:

an electric resistance heater located on an inner shoe of a ski boot and positioned at a user's foot;

at least one storage battery accomodated in a seat defined in said inner shoe;

said storage battery is electrically connected with said electric resistance heater;

an electric storage battery recharging socket located at the top portion of said inner shoe;

said electric storage battery recharging socket is connected to said storage battery;

an electric switch provided between said storage battery and said electric resistance heater;

a foil to radiate the heat toward the interior of said inner shoe and to provide thermal insulation to prevent heat loss from therein;

a lower portion of said electric resistance heater arranged to contact with said foil;

an insole associated with an uppers of said inner shoe and supporting said foil.

2. A heater device particularly for ski boots according to claim 1, characterized in that said electric recharging socket connected to said storage battery is located at either the front or side or rear upper portion of said inner shoe.

3. A heater device particularly for ski boots according to claim 1, characterized in that said electric switch is located beside said recharging socket.

4. A heater device for ski boots comprising an electric resistance heater located on an inner shoe of a ski boot and positioned at a user's foot;

at least one storage battery accomodated in a seat defined in said inner shoe;

said storage battery is electrically connected with said electric resistance heater;

an electric storage battery recharging socket located at the top portion of said inner shoe;

said electric storage battery recharging socket is connected to said storage battery;

an electric switch provided between said storage battery and said electric resistance heater;

a foil to radiate the heat toward the interior of said inner shoe and to provide thermal insulation to prevent heat loss from therein;

a lower portion of said electric resistance heater arranged to contact with said foil;

an insole associated with an uppers of said inner shoe and supporting said foil;

a voltage limiter adapted to cut off the electric supply to said resistance heater upon reaching a threshold voltage level preset for said at least one storage battery.

5. A heater device particularly for ski boots according to claim 4, characterized in that said voltage limiter is arranged in the electric path between said electric resistance heater and said storage battery.

6. A heater device particularly for ski boots according to claim 4, characterized in that said voltage limiter has input terminals connected to terminals of said storage battery to monitor the voltage level thereof.

* * * * *